US005423261A

United States Patent [19]

Bernardy et al.

[11] Patent Number: 5,423,261

[45] Date of Patent: Jun. 13, 1995

[54] PYROTECHNIC TRIGGER

[75] Inventors: Jean-Claude Bernardy; Moya-Naranjo, both of Aureilhan; Guy Lagofun, Tarbes; Hervé LeBreton, Laloubere, all of France

[73] Assignee: Giat Industries, Versailles, France

[21] Appl. No.: 158,798

[22] Filed: Dec. 1, 1993

[30] Foreign Application Priority Data

Dec. 1, 1992 [FR] France ..... 92 14473

[51] Int. Cl.[6] ..... F42C 19/12

[52] U.S. Cl. ..... 102/202.14; 102/202.2; 102/202.5; 102/202.9

[58] Field of Search ..... 102/202, 202.2, 202.5, 102/202.7, 202.8, 202.9, 202.12, 202.14, 275.11, 311, 470, 472

[56] References Cited

U.S. PATENT DOCUMENTS

| | | | |
|---|---|---|---|
| 2,516,898 | 8/1950 | Meister . | |
| 2,767,655 | 10/1956 | Seavey . | |
| 2,968,985 | 1/1961 | Seavey . | |
| 3,308,758 | 3/1967 | Stader et al. | 102/202.8 |
| 3,760,729 | 9/1973 | Freeman | 102/466 |
| 3,831,523 | 8/1974 | Thomas et al. | 102/202.7 |
| 3,971,320 | 7/1976 | Lee | 102/202.9 |
| 4,576,094 | 3/1986 | Meador . | |
| 4,819,560 | 4/1989 | Patz et al. . | |
| 5,005,486 | 4/1991 | Lenzen | 102/202.5 |
| 5,166,468 | 11/1992 | Atkeson | 102/207 |
| 5,241,910 | 9/1993 | Cunningham et al. | 102/202.9 |

FOREIGN PATENT DOCUMENTS

| | | | |
|---|---|---|---|
| 0488863 | 6/1992 | European Pat. Off. . | |
| 1127263 | 12/1956 | France . | |
| 2506927 | 5/1981 | France . | |
| 2513751 | 9/1981 | France . | |
| 2538099 | 12/1982 | France . | |
| 2355255 | 5/1975 | Germany | 102/472 |

*Primary Examiner*—Harold J. Tudor
*Attorney, Agent, or Firm*—Oliff & Berridge

[57] ABSTRACT

A pyrotechnic trigger includes a pyrotechnic substance disposed inside a recess provided in a housing made of plastic. The recess has a cylindrical wall having at least one window of reduced thickness forming a single piece with the wall. The housing is designed to break when the pyrotechnic substance is triggered.

10 Claims, 6 Drawing Sheets

PYROTECHNIC TRIGGER

BACKGROUND OF THE INVENTION

The field of the present invention is that of pyrotechnic triggers, namely components allowing a pyrotechnic effect to be transmitted to a pyrotechnic chain.

Triggers used in the armaments sector are already known. In general they consist of a metal cell into which a pyrotechnic substance is pressed. French Patents FR 2,506,927, FR 2,513,751, and FR 2,538,094 describe such triggers. Although these devices are reliable, they suffer from high production cost.

The cell is made of relatively thin metal and must be closed by a metal barrier designed to break under the pressure generated by the pyrotechnic substance. The barrier is itself coated with varnish to ensure a seal against environmental moisture.

Production of such a cell is expensive as it requires a number of delicate operations. In the case of triggering by electric current, the electrodes are mounted on an insulating base, usually made of sintered glass or ceramic. This base is fragile and fairly expensive to manufacture. In addition, the cell itself must be installed inside a supporting housing that will carry the electrical connectors and allow the trigger to be installed in the pyrotechnic chain.

As a result, the triggers of the prior art are unsuitable for large scale production at low cost, as industry requires.

U.S. Pat. Nos. 2,968,985, 2,767,655, and 4,819,560 teach triggers having housings made of plastic. These inexpensive triggers are designed in particular to trigger explosive cartridges used in the mining or quarrying industry. They generally have a housing of constant thickness that contains the trigger charge and that is fragmented when the trigger charge is triggered.

Such trigger, however, does not allow the size of the housing fragments obtained to be controlled, which is a drawback for application to technical areas other than quarrying, for example in the armaments industry or the safety systems industry.

U.S. Pat. No. 4,576,094 describes a plastic trigger for a missile propulsion unit that has a thin cylindrical wall that is fragmented when triggered. The goal is to prevent the missile nozzle from becoming clogged with the trigger residues. This trigger, however, is expensive to manufacture as it requires extremely thin cylindrical parts to be manufactured and then to be assembled after filling with a sensitive pyrotechnic composition. In addition, the thinness of its envelope renders it fragile so that it is difficult to use in areas where mechanical constraints (impacts, vibrations) are considerable (armaments, automobile safety). Moreover, the thinness of the envelope does not allow the pyrotechnic composition to be sufficiently contained. Finally, its thin envelope is surmounted by a solid lid that could jam or disrupt the pyrotechnic systems it is supposed to trigger.

SUMMARY OF THE INVENTION

Accordingly, a goal of the invention is to provide a trigger that overcomes the disadvantages in the prior art described above.

Thus, the invention sets out to provide a trigger that is both reliable, sturdy, and inexpensive, while ensuring triggering that generates a minimum quantity of debris in order not to disrupt the triggered system.

Another goal of the invention is to provide a trigger that can be manufactured in large production runs at lesser cost and safely, so that it can be used for example to trigger safety devices used in vehicles, particularly automobiles.

The trigger according to the invention is made of plastic. The advantage of such an arrangement is that it allows the trigger as a whole to be made easily and inexpensively.

With such a trigger, however, it is difficult to provide all the functions that a trigger housing must carry out. In particular, the housing must be sufficiently rigid to hold the pyrotechnic substance, which is pressed directly into the interior of the housing. It must also be fragile enough to allow pyrotechnic transmission along one or more directions (role of metal barrier) and nonetheless ensure a seal. Finally, it may have to include electrodes in a sufficiently rigid manner to prevent the triggering device (wire resistor or semiconductor board) from breaking while ensuring a seal where the electrodes pass through.

The totality of these functions, which are extremely important and sometimes contradictory (rigidity/-fragility), was thus far carried out by an assemblage of various elements with good mechanical properties (rigid metal cell, insulating base for mounting the electrodes, fine metal barrier, varnish seal).

A single type of material can properly carry out all of these functions and thus allow for considerable savings in production costs with no loss in performance. The production cost of such a trigger can thus be approximately 1% of that of a trigger according to the prior art with no loss in performance.

It is thus possible to make the entire housing structure in one or two casting operations, which structure has the function of mechanically holding the pyrotechnic substance, mechanical holding and electrical insulation of the electrodes, and moisture seal of the recess containing the pyrotechnic substance.

Thus, the invention is directed to a pyrotechnic trigger having a pyrotechnic substance disposed inside a recess provided in a housing made of plastic, which recess has a cylindrical wall. The wall includes at least one window of reduced thickness forming a single piece with the wall and is designed to break when the substance is triggered.

Thus, the material of the housing provides rigidity and containment, and the presence of reduced-thickness zones in the housing itself or on its plug allows pyrotechnic transmission with a minimum number of fragments.

BRIEF DESCRIPTION OF THE DRAWINGS

The invention will be better understood by reading the description hereinbelow of particular embodiments, with reference to the attached drawings, wherein.

DETAILED DESCRIPTION OF PREFERRED EMBODIMENTS

According to a preferred embodiment, the windows are provided outside the wall, in which case the recess has a smooth cylindrical inner surface. Such an arrangement facilitates the pressing of the pyrotechnic substance into the recess.

According to another characteristic, the housing is closed by a plug also made of plastic. Choice of an identical plastic for the plug and the housing simplifies the design of the trigger by limiting studies of chemical compatibility between the components of the housing and the pyrotechnic substance.

According to one embodiment of the invention, the plug has a reduced-thickness zone designed to break when the substance is triggered. The reduced-thickness zone is then provided on the plug and not on the housing, which allows triggering to be ensured along an axial direction of the housing.

According to a particular embodiment, the housing closure plug has an annular groove in which a tapered cylindrical end of the housing is fitted, with the plug resting on the pyrotechnic substance. Such an arrangement ensures slight compression of the substance when the plug is attached, which increases the safety and reliability of the trigger by preventing any substance-free void inside the housing.

In the case where the trigger has a substance-triggering device at the bottom of the housing, such an arrangement also provides a good contact between the substance and the triggering device. The triggering device may be a wire resistor, a semiconductor board, or the end of an optical fiber.

According to another embodiment of the invention, the housing is formed of a base and a skirt joined to each other by a linking device, which skirt bears the wall in which the windows are made. Such an embodiment facilitates the manufacture of the housing, particularly the attachment of the triggering device to the bottom of the housing (for example, welding a wire resistor or a semiconductor board onto the electrodes).

According to another characteristic, the skirt has a length between 1.5 and 2.5 times the diameter of the recess.

The housing may be coated with metal and/or covered by a metal cap that covers both the plug and the cylindrical wall.

According to a particular embodiment, the trigger has two electrodes embedded in the material of the housing whose ends jut out slightly at a base of the recess into the recess, the casting length of the electrode being 5 to 10 times the electrode diameter.

The plug is preferably attached to the housing by ultrasonic welding. Likewise, the skirt and base of the housing are joined to each other by ultrasonic welding.

The plastic material of the housing and/or the plug is preferably of the polyamide or polycarbonate type. It may for example be polycarbonate reinforced with glass fibers.

According to a preferred embodiment, the pyrotechnic substance is introduced into the housing by a wet loading method. This loading method ensures safety of manufacture and optimally fills the recess of the housing.

Figure 1:
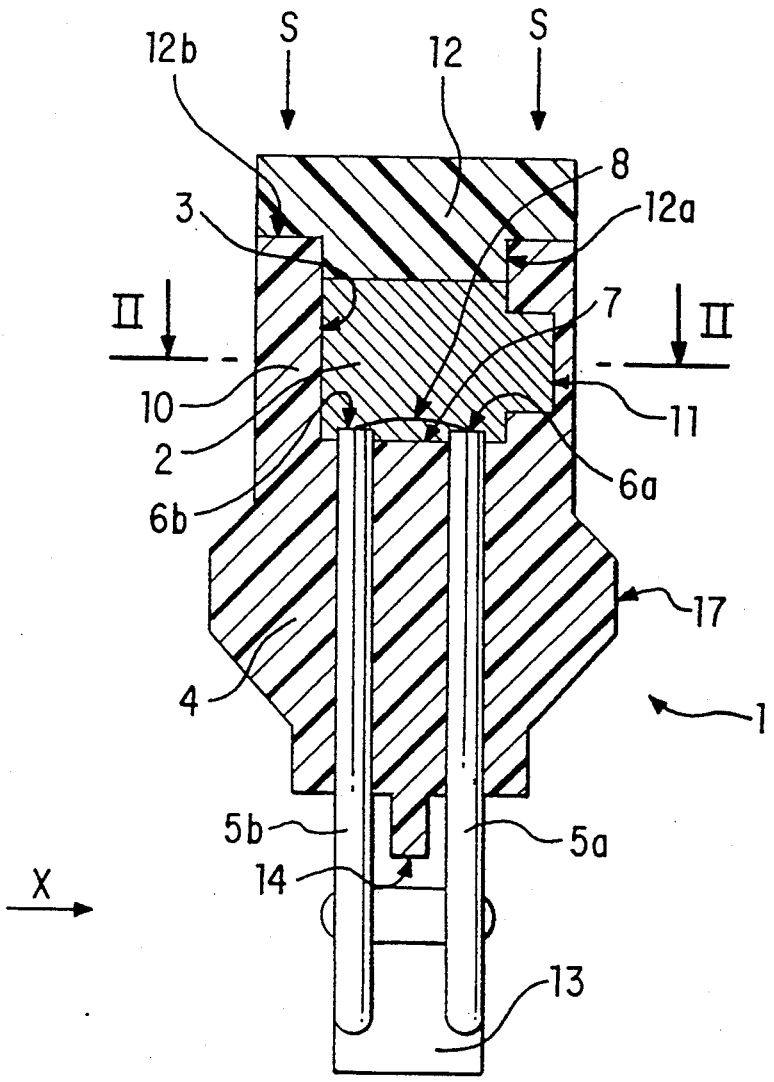
FIG. 1 is a lengthwise section through a trigger according to a first embodiment of the invention.
Figure 2:
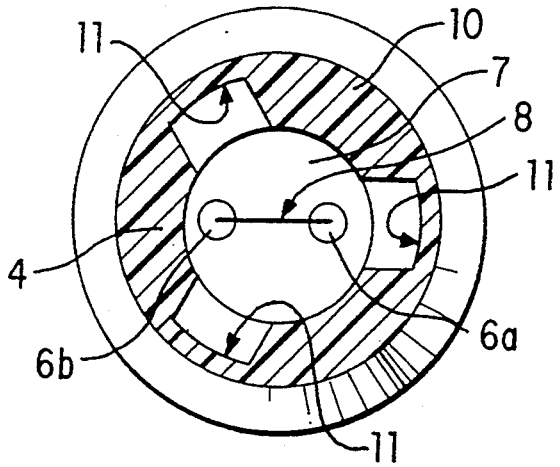
FIG. 2 is a cross section of the foregoing in a plane shown by the line II in FIG. 1 (shown without the pyrotechnic substance)

With reference to FIG. 1, a trigger 1 according to the invention has a pyrotechnic substance 2 of a known type (for example an explosive (detonator) or a flammable pyrotechnic composition), which substance is disposed in a substantially cylindrical recess 3 that is provided in a housing 4.

Housing 4 is traversed by two metal electrodes 5*a*, 5*b* whose ends 6*a*, 6*b* extend slightly (a few tenths of a millimeter) beyond a bottom 7 in recess 3.

One means of triggering the pyrotechnic substance attached between the electrodes is a wire resistor 8 that connects electrodes 5*a* and 5*b* and that is attached by welding to each of ends 6*a* and 6*b*.

The electrical characteristics of resistor 8 are determined classically by the individual skilled in the art as a function of the pyrotechnic characteristics of substance 2. For example, a 2-ohm wire resistor could be used for a substance of the quaternary type (containing four elements, such as a substance known as the potassium perchlorate/lead thiocyanate/antimony sulfide/lead tricinate combination).

Housing 4 is made of a plastic of the polyamide or polycarbonate type, which material may be reinforced with glass fibers to increase its mechanical strength.

Thus, housing 4 is cast or injected onto electrodes 5*a* and 5*b*. The electrodes may have roughnesses on their outer surfaces to improve the adhesion of the material of which the housing is made and to increase the mechanical strength of the trigger.

In order to ensure sufficient rigidity of the electrodes when assembled in the housing (and hence retention of the wire resistor), housing 4 is defined such that the length of the casting on the electrodes is sufficient, namely 5 to 10 times the electrode diameter.

Figure 4:
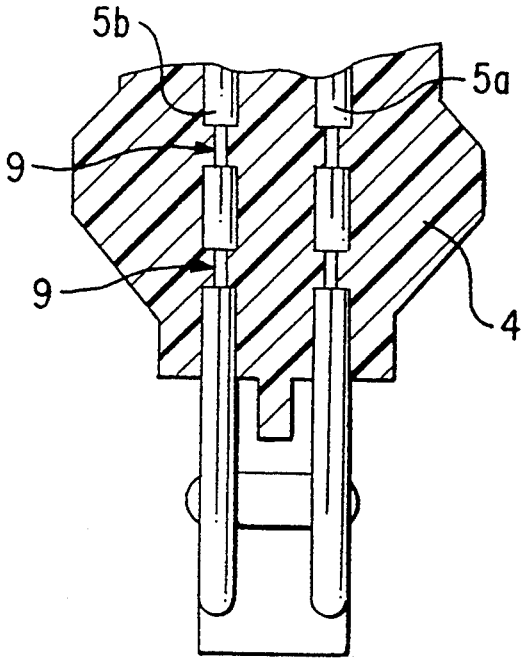
FIG. 4 shows an alternative method of installing the electrodes on the housing.

FIG. 4 shows an alternative embodiment in which the electrodes have constrictions 9, inside which the material of the housing penetrates upon manufacture. Housing 4 has a bulge 17 that provides a support, allowing it to be installed for example in a recess provided in a pyrotechnic substance or in a trigger device, not shown (the recess has the same diameter as the housing).

Cylindrical wall 10 of recess 3 has three zones 11 of reduced thickness. The thickness reduction is effected inside recess 3 so that this thickness reduction is not visible from the outside of the trigger; thus the exterior of wall 10 has a smooth cylindrical surface.

Reduced thickness zones 11 are easily obtained when the housing is manufactured by molding with an appropriate tool. It is sufficient to provide a mold of which a moving part has the desired diameter for recess 3 and has three sliding fingers that shape the reduced thickness zones 11.

Zones 11 constitute fragile windows that will be broken by the pressure generated by the pyrotechnic substance when it is triggered. The thickness of these windows is approximately 0.5 to 1 mm. Hence, they will play the role of barriers in the triggers according to the prior art, but do not require an additional assembly stage since they are made with the housing and form a single piece with the housing. Zones 11 thus connect the trigger to a pyrotechnic chain in a radial direction.

Pyrotechnic substance 2 is pressed into recess 3. During this manufacturing stage, it penetrates inside reduced thickness zones 11. The mechanical strength of the windows is unaffected by the pressing operation despite their limited thickness. This is because, during this operation, the cylindrical outer surface of wall 10 is held in a tool of matching shape, which tool holds the windows and allows the pyrotechnic substance to be pressed without the windows being deformed.

Recess 3 is closed by a plug 12 having a cylindrical part 12*a* of smaller diameter that is fitted into recess 3 and a shoulder 12*b* that rests on housing 4. Fitting cylindrical part 12*a* into the recess increases the rigidity of housing 4 at wall 10.

The plug is made of the same material as housing 4. It is attached to the housing by ultrasonic welding. For this purpose, a sonotrode of a welding machine is applied to a circular crown of the flat outer surface of the plug, which crown is located substantially at right angles to wall 10 of the housing (marked "S"). As a result, the trigger is a totally sealed unit.

Figure 3:
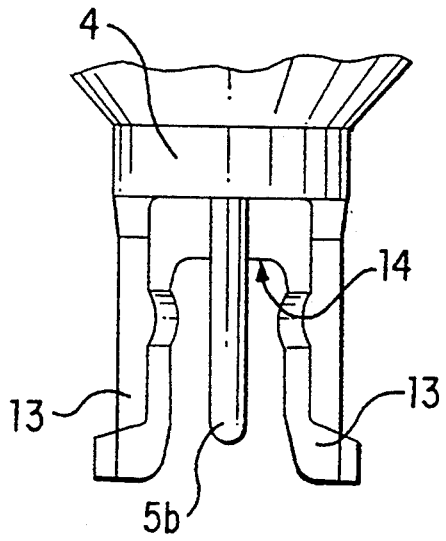
FIG. 3 shows a detail of the lower part of the housing along direction X in FIG. 1.

The lower part of housing 4 of the trigger has two elastic fingers 13 and a positioning tongue 14 that allow the trigger to be attached in known fashion to an electrical connector. FIG. 3 shows the lower part of the housing viewing in direction X in FIG. 1 and makes clear the shape of fingers 13.

It can thus be seen that the trigger according to the invention can be manufactured easily and at lower cost, as manufacture requires few operations, and each operation is simple and easily automatable.

In fact, the entire housing equipped with its electrodes can be manufactured in a single casting operation. The resistor is welded onto the electrodes by welding techniques suitable for wiring integrated circuits, which techniques are simple and allow high rates of manufacture. The substance is pressed directly into the recess of the housing and onto the resistor. The plug is welded onto the housing and provides a perfect seal while increasing the mechanical rigidity of the whole. Alternatively, the plug can be attached to the housing by gluing. It is also possible to attach the housing by snapping.

Figure 5:
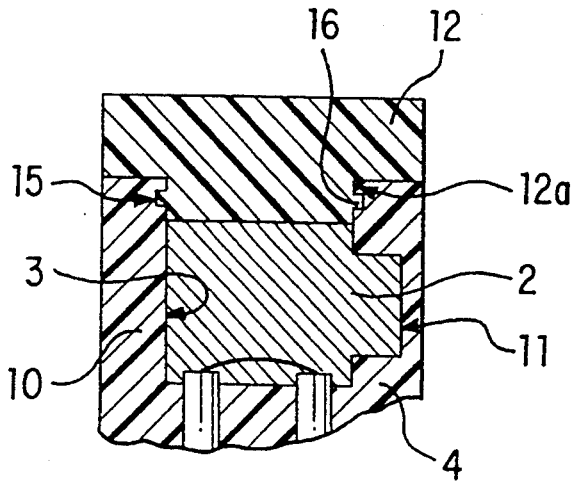
FIG. 5 shows an alternative method of installing the plug on the housing.

FIG. 5 shows in detail the manner in which the plug is attached to the housing in the case of this latter embodiment. Housing 4 has an annular groove 15 in its recess 3 into which a bead 16 provided on cylindrical part 12*a* of the plug penetrates. Installation is accomplished by elastic deformation. The seal is completed by applying varnish to the outer surface of wall 10 at the separation between the plug and the housing. The link can also be completed by applying glue between shoulder 12*b* of the plug and the housing.

Figure 6:
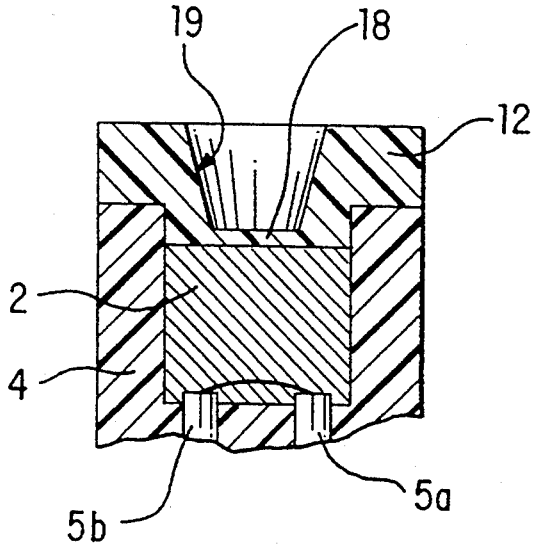
FIG. 6 shows another method of installing the plug on the housing.

As a alternative embodiment, it is also possible to create a trigger in which housing 4 has no reduced-thickness zones 11, but in which a reduced-thickness zone 18 is provided in plug 12 (see FIG. 6). Zone 18 is obtained directly when plug 12 is cast, providing a cavity 19 having a conical or cylindrical shape. Cavity 19 is disposed outside plug 12 so that reduced-thickness zone 18 comes in contact with pyrotechnic substance 2 and retains the pyrotechnic substance.

Alternatively, it would be possible to dispose cavity 19 inside plug 12. It would also be possible to provide several reduced-thickness zones 18 on the plug. The pressure generated by pyrotechnic substance 2 will break reduced-thickness zone 18. The latter type of trigger will allow transmission of a pyrotechnic effect to a pyrotechnic chain in an axial direction of the housing.

It is also possible to define a component according to the invention in which the pyrotechnic substance is triggered by a technique different from that of the wire resistor and uses yet another triggering means.

For example, electrodes 5*a* and 5*b* can be welded to a semiconductor board, a printed circuit board, or an integrated circuit board, which can itself be glued to bottom 7 or recess 3. The board then constitutes the means for triggering the pyrotechnic substance.

The semiconductor bridge triggering method is known to the individual skilled in the art and will not be described in greater detail. Reference may be made for example to U.S. Pat. No. 4,924,774, which describes a semiconductor bridge trigger.

Triggering can also be accomplished optically, by replacing the electrodes with a support for an optical fiber during casting of the housing. The end of the optical fiber then constitutes the means for triggering the pyrotechnic substance. The substance in this case will be a substance sensitive to photons (to light intensity or to a shock wave). Such substances are known to the individual skilled in the art and will not be described in greater detail. Reference may be made to French Patents FR 9,002,566 and FR 9,014,662 that describe such substances.

Finally, a component according to the invention designed to be triggered by mechanical percussion could be made. In this case, the housing will have a first reduced-thickness zone designed to be traversed by a striker and at least one other reduced-thickness zone provided on the wall of the housing or on the plug. The zone is designed to transmit the pyrotechnic effect to a pyrotechnic chain.

Figure 7:
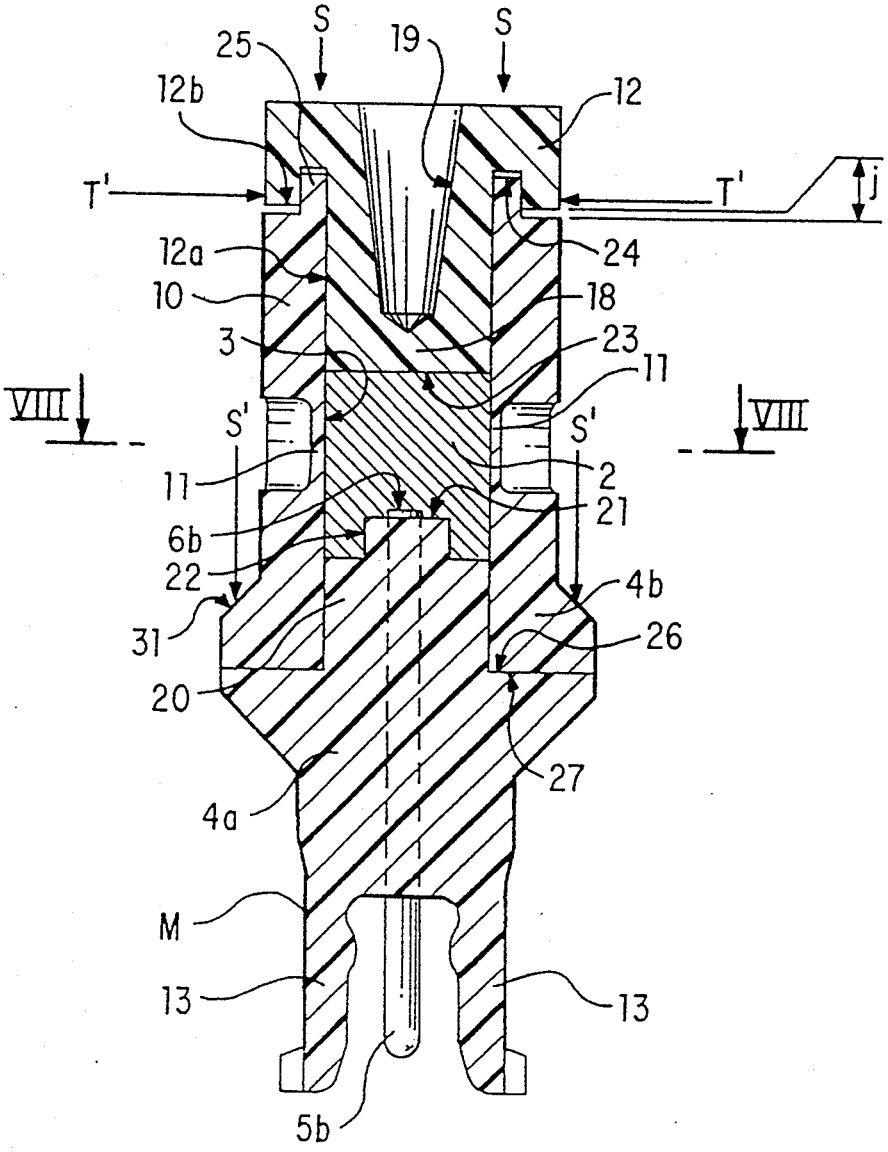
FIG. 7 is a lengthwise section through a trigger according to a second embodiment of the invention.
Figure 8:
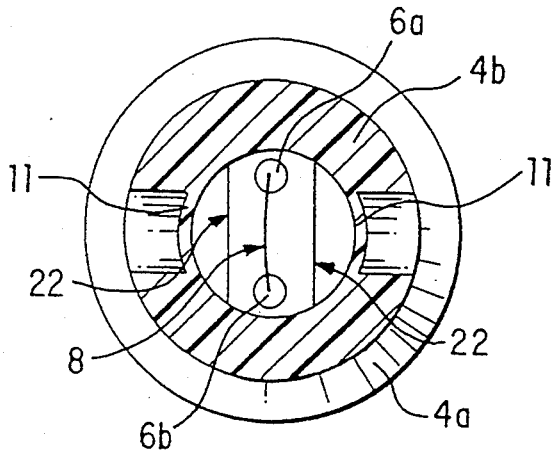
FIG. 8 is a cross section through the foregoing in a plane shown by the line VIII—VIII in FIG. 7 (shown without the pyrotechnic substance)

FIGS. 7 and 8 represent a second embodiment of a trigger according to the invention.

Housing 4 comprises a base 4*a* and a skirt 4*b*. Both the base and the skirt are made of a plastic material of the polycarbonate type reinforced with glass fibers to increase the mechanical strength. For example, a percentage of 10 to 40% wt. of short glass fibers (some tenths of a millimeter long) will be used.

Base 4*a* has at its lower part, elastic fingers 13 for attachment, which fingers are identical to those described above and will hence not be described in further detail.

Base 4*a* has a central cylindrical tip 20 on which skirt 4*b* is fitted. The skirt is attached to the base by ultrasonic welding, but any suitable method of attachment such as gluing could be used.

Ultrasonic welding is performed in a known fashion by applying a sonotrode of a welder to the outer conical surface 31 (in the directions marked S'). The vibrations of the sonotrode cause welding of the surfaces in contact, namely the outer cylindrical surface of the tip and that of the skirt as well as flat supporting surfaces 26 and 27.

As in the above embodiments, metal electrodes 5*a* and 5*b* pass through base 4*a*, and their ends 6*a*, 6*b* jut out slightly at the upper surface 21 of central tip 20. A wire resistor 8 is welded onto each of ends 6*a* and 6*b*.

Central tip 20 has two flats 22 whose function is to allow positioning of a tool (not shown) for welding the wire resistor to the ends of the electrodes.

Base 4*a* is cast onto electrodes 5*a* and 5*b*. The length of the casting of each electrode is between five and ten times its diameter to ensure sufficient rigidity of the electrodes when assembled.

Skirt 4b has two reduced-thickness zones forming windows 11. The thickness reduction is effected outside skirt 4b so that recess 3 has a smooth cylindrical inner surface.

The advantage of such an arrangement is that it facilitates the filling of recess 3 with pyrotechnic substance 2. Recess 3 is completely filled, which improves the reliability of the trigger. The presence of a space containing no pyrotechnic substance would entail the risk of internal friction and in particular might cause misfiring if the wire resistor were not in intimate contact with the pyrotechnic substance.

Pyrotechnic substance 2 is press inserted into recess 3. The mechanical strength of windows 11 is ensured by the pressing force relative to the mechanical strength of the windows.

The division of housing 4 into two parts, a base 4a and a skirt 4b, facilitates the installation of resistor 8 (or another triggering means such as a semiconductor board or an optical fiber). Thus, resistor 8 is welded onto base 4a equipped with electrodes. Welding is facilitated because the welder does not have to penetrate a cylindrical recess to reach ends 6a and 6b. The flats guide the welder, increasing the accuracy and speed of the operation.

After the resistor has been welded, skirt 4b is attached to base 4a. It is preferably attached on the same transfer machine, just after the resistor welding station, preventing any deterioration in the resistor due to manipulations of base 4a.

The pyrotechnic substance is then deposited according to a known wet loading process.

The substance is for example a quaternary substance of a known type combining, in classical proportions not specified here and which are well known to the individual skilled in the art:

- a primary explosive (such as lead tricinate),
- an oxidant (such as potassium perchlorate, potassium chlorate, or potassium nitrate),
- a reducer (such as antimony sulfide, calcium silicide, graphite, or powdered aluminum), and
- an additive to increase or decrease the power of the trigger (such as lead thiocyanate, aluminum powder, or lead dioxide).

The substance is mixed in a ratio of 1 to 5% wt. with a binder such as natural rubber or a synthetic binder and with water (5 to 30% wt.). The advantage of making a wet mix is that it is then possible to work the mix and divide the substance, reducing the risks of inadvertent triggering.

The substance is thus shaped into pellets with the same diameter as recess 3 of the housing with an appropriate tool. A punch provides moderate compression (20 to 40 megapascals) of the pellets, which allows the pyrotechnic substance completely to fill recess 3 and be in intimate contact with resistor 8.

The compression also has the effect of driving the water to the top of the substance. The loaded triggers then go into a hot tunnel (50° to 80° C.), which causes the water to evaporate. Drying of the substance has the effect of restoring its sensitivity.

A plug 12 made of a material identical to that of the housing is positioned to close recess 3. Plug 12 has a front face 23 that rests on pyrotechnic substance 2. The cylindrical part 12a of the plug is fitted into recess 3, which increases the rigidity of housing 4 at wall 10 of skirt 4b. There remains a play "j" on the order of one-tenth of a millimeter between shoulder 12b of the plug and housing 4 (the play is exaggerated in the figure).

Plug 12 has an annular groove 24 that receives a reduced cylindrical end 25 of skirt 4b. Such an arrangement is designed to attach the plug to the skirt (for example by ultrasonic welding) while keeping the plug resting on the pyrotechnic substance.

It will be possible to alter the depth of the groove to increase the contact surface between the plug and the skirt, which increases the mechanical strength of the weld.

Ultrasonic welding is carried out in a known manner by applying a sonotrode of a welder to a circular crown of the flat outer surface of the plug, which crown is located substantially at right angles to the reduced end 25 of skirt 4b (marked "S"). The vibrations of the sonotrode bring about welding of the surfaces in contact, namely the cylindrical surfaces of end 25 and groove 24.

It would also be possible to weld by applying the sonotrode to the outer cylindrical surface of plug 12 opposite reduced end 25 (marked "T").

During the welding operation, the presence of play j (about one-tenth of a millimeter) keeps plug 12 resting against pyrotechnic substance 2.

Such an arrangement avoids having an empty space inside the housing, which limits the risks of friction, and ensures a good contact between the pyrotechnic substance and the triggering means. Thus, the safety and reliability of the trigger are increased. In the case where the substance is loaded by the wet method, the plug is welded after the water has evaporated, as described above. Plug 12 has a cavity 19 located outside the plug that provides a reduced-thickness zone 18 on the plug. Zone 18 allows a pyrotechnic effect to be transmitted along an axial direction of the trigger and ensures that the plug will break at a predetermined location in addition to windows 11. This limits fragmentation of housing 4 when pyrotechnic substance 2 is triggered, preventing fragments of housing material from interfering with operation of the pyrotechnic system ignited by the trigger.

The outer surface of the trigger is fully covered (except for the surface separating the electrodes) with a layer of a conducting material m, for example stainless steel. This layer is deposited by known evaporation vacuum metallization technology. Deposition could also be effected by sputtering, cathode sputtering, or electrodeposition. Other conducting materials, particularly metallic materials, could be used, for example aluminum, chromium, or nickel. The coating forms a Faraday cage that protects the trigger from currents induced by the electromagnetic environment.

The creation of attachments of the base and skirt as well as the skirt and plug by ultrasonic welding leads to a perfect seal of the trigger against external agents (moisture, grease, solvents, etc.), which is particularly advantageous in the case of components intended for automobiles.

Because of the separation of housing 4 into two parts, a base 4a and a skirt 4b, it is easy to weld the wire resistor to the electrodes, and it becomes possible to install a skirt of substantial length without thereby adversely affecting the ease of manufacture.

In order to ensure sufficiently rigid attachment of the plug, it is preferable for cylindrical part 12a of the plug to have a length greater than or equal to 0.5 times its diameter.

Thus, it can be seen that by choosing a skirt of sufficient length it is possible to design triggers of different powers while using the same housing 4. It is sufficient for this purpose to place in recess 3 a different weight of pyrotechnic substance 2 and provide a plug 12 of different length.

Figure 7A:
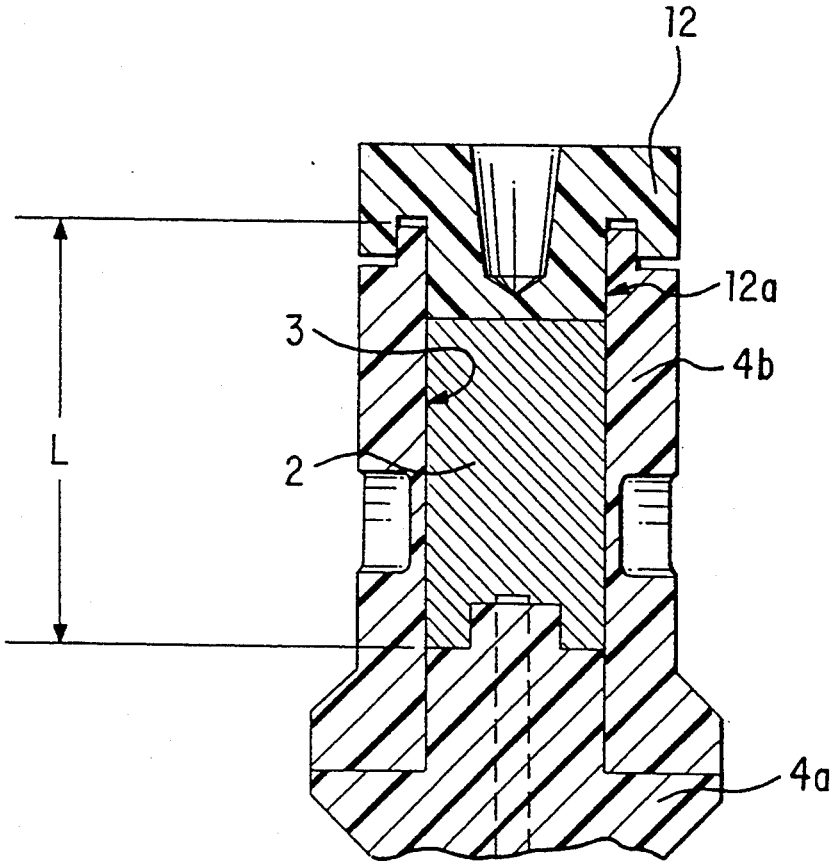
FIG. 7*a* shows a variation of the second embodiment.

FIG. 7*a* thus shows a trigger (whose skirt is identical to that of the trigger in FIG. 7), containing twice the amount of pyrotechnic substance 2. This trigger is then closed by a plug whose cylindrical part 12*a* is half the length.

In practice, the total length L of skirt 4*b* will be between 1.5 and 2.5 times the diameter of recess 3 (and preferably equal to twice the diameter). Such an arrangement allows the mass of pyrotechnic substance to be varied considerably while plug 12 continues to have a cylindrical guidance surface whose length is 0.5 times the diameter of recess 3.

Figure 9:
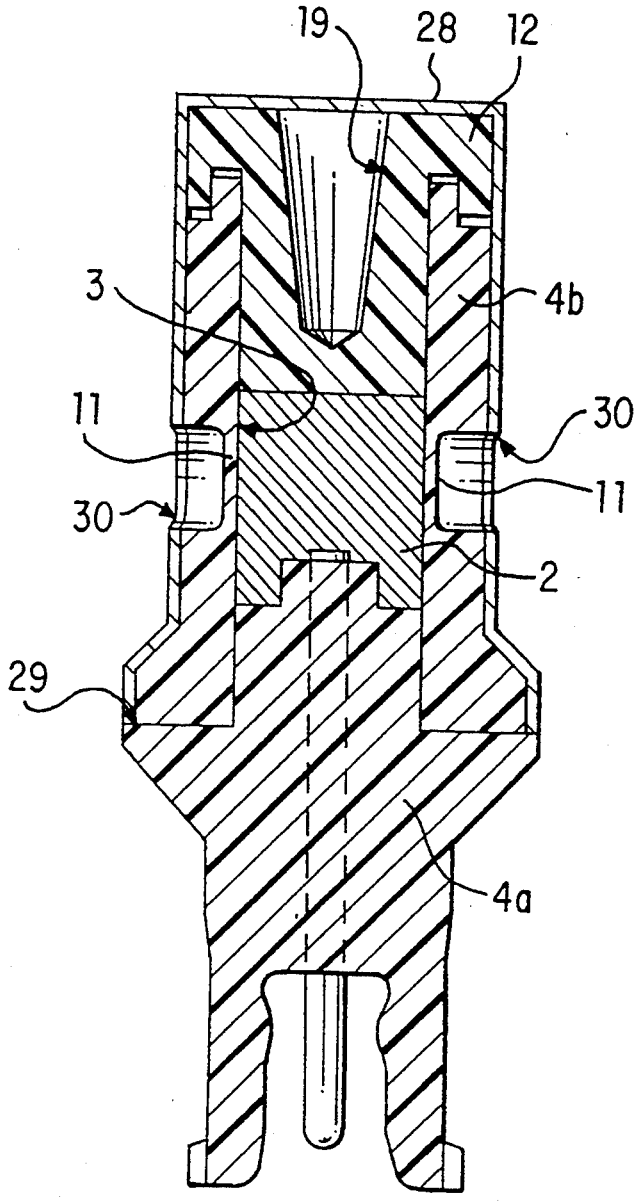
FIG. 9 is a lengthwise section through a trigger according to a third embodiment of the invention.

FIG. 9 shows a final embodiment of the invention, wherein housing 4 is similar to that shown in FIGS. 7 and 8, having a base 4*a* and a skirt 4*b*. This housing will thus not be described in further detail.

In this embodiment, a metal cap 28 is made of brass several tenths of a millimeter thick, which is covered with chromium to prevent it from rusting. It completely surrounds plug 12 and skirt 4*b* and rests by its end on an abutting surface 29 of base 4*a*. Cap 28 is provided with circular openings 30 located opposite windows 11 and is force-fitted onto the housing (tight fit on the outer cylindrical surface of the housing obtained for example by giving the inside of the cap a sightly conical shape).

One function of the cap is to complete the Faraday cage surrounding the pyrotechnic trigger. Thus, it is in electrical contact with the metal covering housing 4.

Another function of the cap is to ensure, under all operating conditions, maintenance of the cohesion of the housing after triggering of the pyrotechnic substance. In cases where the pressure generated upon triggering causes housing 4 to crack, cap 28 holds the various pieces of the housing and prevents them from scattering in the triggered pyrotechnic system. This increases the reliability of the trigger by ensuring that in every case, a fragment of housing 4 will not interfere with the operation of the triggered system.

Such an arrangement is particularly useful for high-safety applications, for example triggering automobile air bags. Thus, one can be sure that fragments of housing will not block up the inflation holes of the bag, which would thereby severely hamper its efficiency.

In the case where the trigger has no window in the housing but a reduced-thickness zone on the plug (to ensure triggering along one axial direction of the housing), only one opening will be provided on the cap, opposite the reduced-thickness zone of the plug.

As an alternative embodiment, it is possible to dispose in the housing a dry pyrotechnic substance. Compression of the substance in the recess of the housing will then be effected at a higher pressure (e.g. approximately 100 to 200 megapascals). Plug 12 will as before be held against the pyrotechnic substance when it is welded onto the skirt.

While the embodiments disclosed are preferred, it will be appreciated from this teaching that various alternatives, modifications, variations or improvements therein may be made by those skilled in the art that are within the scope of the invention, which is defined by the following claims.

What is claimed is:

1. A pyrotechnic trigger comprising a plastic housing having a recess therein, said recess receiving a pyrotechnic substance and comprising a cylindrical wall having at least one window of reduced thickness forming a single piece with the wall, wherein said at least one window breaks when said pyrotechnic substance is triggered, said housing being closed by a plastic plug comprising an annular groove receiving cylindrical end of said housing, said plug further comprising:

an extension portion extending into said recess;

a front face at an end of said extension portion, said front face resting on the pyrotechnic substance; and a cavity delimited by said extension portion and said front face, said cavity defining a reduced thickness zone adjacent said front face, wherein said reduced thickness zone breaks when said pyrotechnic substance is triggered.

2. A trigger according to claim 1, wherein said at least one window is disposed outside of said wall, said recess thereby having a smooth cylindrical inner surface.

3. A trigger according to claim 1, wherein said housing comprises a base and a skirt joined to each other by a linking means, said skirt bearing said wall.

4. A trigger according to claim 3, wherein the skirt has a length between 1.5 and 2.5 times the diameter of said recess.

5. A trigger according to claim 1, wherein said housing is coated with metal.

6. A trigger according to claim 1, further comprising two electrodes embedded in said housing, an end of each of said electrodes extending into said recess, a length of each of said electrodes being about 5 to 10 times its diameter.

7. A trigger according to claim 1, wherein said plug is attached to said housing by ultrasonic welding.

8. A trigger according to claim 3, wherein the skirt and the base of the housing are joined to each other by ultrasonic welding.

9. A trigger according to claim 1, wherein the plastic material of at least one of said housing and said plug is selected from the group consisting of polyamides and polycarbonates.

10. A trigger according to claim 9, wherein the plastic material of at least one of said housing and said plug is a polycarbonate reinforced with glass fibers.

* * * * *

UNITED STATES PATENT AND TRADEMARK OFFICE

CERTIFICATE OF CORRECTION

PATENT NO. : 5,423,261

DATED : June 13, 1995

INVENTOR(S) : Jean-Claude Bernardy; Moya-Naranjo; Guy Lagofun, Hervé LeBreton

It is certified that error appears in the above-indentified patent and that said Letters Patent is hereby corrected as shown below:

ON THE TITLE PAGE

Item 75, please change the second inventor's name "Moya-Naranjo" to --Yves Moya-Naranjo--.

Signed and Sealed this

Fifteenth Day of August, 1995

Bruce Lehman

*Attest:*

BRUCE LEHMAN

*Attesting Officer*

*Commissioner of Patents and Trademarks*